US008453454B2

(12) United States Patent
Lacy et al.

(10) Patent No.: US 8,453,454 B2
(45) Date of Patent: Jun. 4, 2013

(54) COANNULAR OIL INJECTION NOZZLE

(75) Inventors: Benjamin Paul Lacy, Greer, SC (US); Thomas Edward Johnson, Greer, SC (US); William David York, Greer, SC (US); Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 73 days.

(21) Appl. No.: 12/759,794

(22) Filed: Apr. 14, 2010

(65) Prior Publication Data

US 2011/0252802 A1 Oct. 20, 2011

(51) Int. Cl.
*F02C 1/00* (2006.01)

(52) U.S. Cl.
USPC ..... 60/746; 60/740

(58) Field of Classification Search
USPC ..... 60/737, 740, 748, 738, 739, 746, 60/747
See application file for complete search history.

(56) References Cited

U.S. PATENT DOCUMENTS

| | | | | | |
|---|---|---|---|---|---|
| 3,498,727 | A | | 3/1970 | Martin, Jr. et al. | |
| 3,584,967 | A | | 6/1971 | Zerlauth | |
| 3,592,557 | A | | 7/1971 | Haas et al. | |
| 3,628,884 | A | | 12/1971 | Mierley, Sr. | |
| 3,754,833 | A | | 8/1973 | Remberg | |
| 3,937,008 | A | * | 2/1976 | Markowski et al. | 60/776 |
| 4,078,377 | A | | 3/1978 | Owens et al. | |
| 4,112,582 | A | | 9/1978 | Beckershoff | |
| 4,286,921 | A | | 9/1981 | Donlan et al. | |
| 4,650,396 | A | | 3/1987 | Schwarz | |
| 4,890,978 | A | | 1/1990 | McLaurin et al. | |
| 5,020,329 | A | * | 6/1991 | Ekstedt et al. | 60/737 |
| 5,141,394 | A | | 8/1992 | Donlan | |
| 5,165,241 | A | * | 11/1992 | Joshi et al. | 60/737 |
| 5,351,477 | A | * | 10/1994 | Joshi et al. | 60/39.463 |
| 5,511,375 | A | * | 4/1996 | Joshi et al. | 60/39.463 |
| 5,660,045 | A | * | 8/1997 | Ito et al. | 60/737 |
| 5,671,597 | A | | 9/1997 | Butler et al. | |
| 5,675,971 | A | * | 10/1997 | Angel et al. | 60/746 |
| 5,778,676 | A | * | 7/1998 | Joshi et al. | 60/746 |
| 5,921,749 | A | | 7/1999 | McLaurin et al. | |
| 5,941,075 | A | * | 8/1999 | Ansart et al. | 60/748 |
| 6,070,411 | A | * | 6/2000 | Iwai et al. | 60/737 |
| 6,082,963 | A | | 7/2000 | Sexton et al. | |
| 6,192,688 | B1 | | 2/2001 | Beebe | |
| 6,272,840 | B1 | * | 8/2001 | Crocker et al. | 60/776 |
| 6,357,237 | B1 | * | 3/2002 | Candy et al. | 60/737 |
| 6,405,523 | B1 | * | 6/2002 | Foust et al. | 60/776 |
| 6,438,961 | B2 | | 8/2002 | Tuthill et al. | |
| 6,457,963 | B1 | | 10/2002 | Tawara et al. | |
| 6,615,574 | B1 | | 9/2003 | Marks | |

(Continued)

*Primary Examiner* — Gerald Sung
(74) *Attorney, Agent, or Firm* — Cantor Colburn LLP

(57) ABSTRACT

A premixer is provided and includes a peripheral wall defining a mixing chamber therein through which a flow path for a fluid is defined, a nozzle including an annular splitter plate disposed in the flow path within the mixing chamber, the splitter plate including a trailing edge defined in relation to a predominant direction of fluid flow along the flow path and being formed to define a fuel line therein, which is receptive of oil fuel and an annular array of fuel injectors disposed at the trailing edge, which are each fluidly communicative with the fuel line and configured to inject at least the oil fuel into the flow path with the oil fuel being substantially atomized upon injection or substantially immediately after the injection by interaction with the fluid flowing along the flow path.

9 Claims, 3 Drawing Sheets

U.S. PATENT DOCUMENTS

| | | | | |
|---|---|---|---|---|
| 6,640,545 | B2 | 11/2003 | Ruck et al. | |
| 6,993,916 | B2 | 2/2006 | Johnson et al. | |
| 7,007,477 | B2 | 3/2006 | Widener | |
| 7,434,401 | B2 * | 10/2008 | Hayashi | 60/743 |
| 7,669,420 | B2 * | 3/2010 | Spooner | 60/743 |
| 7,878,000 | B2 * | 2/2011 | Mancini et al. | 60/740 |
| 2004/0050057 | A1 | 3/2004 | Bland et al. | |
| 2005/0039456 | A1 * | 2/2005 | Hayashi | 60/737 |
| 2005/0097889 | A1 * | 5/2005 | Pilatis et al. | 60/743 |
| 2005/0247065 | A1 | 11/2005 | Dudebout et al. | |
| 2006/0260316 | A1 | 11/2006 | Stuttaford | |
| 2007/0028619 | A1 * | 2/2007 | Spooner | 60/737 |
| 2007/0130954 | A1 | 6/2007 | Lynch et al. | |
| 2007/0137207 | A1 * | 6/2007 | Mancini et al. | 60/737 |
| 2007/0271927 | A1 * | 11/2007 | Myers et al. | 60/776 |
| 2008/0044782 | A1 | 2/2008 | Kostlin et al. | |
| 2009/0173076 | A1 * | 7/2009 | Toon | 60/746 |

* cited by examiner

COANNULAR OIL INJECTION NOZZLE

BACKGROUND OF THE INVENTION

The present invention relates to gas turbines and, in particular, to an air/fuel premixer for a gas turbine.

Typically, gas turbine engines mix compressed air with fuel for ignition in a combustor to generate combustion gases from which mechanical energy or electrical power are generated. The typical air pollutants produced by gas turbines burning conventional hydrocarbon fuels are nitrogen oxides (NOx), carbon monoxide (CO), and unburned hydrocarbons. The rate of NOx formation correlates to the peak local fuel-air ratio of the mixture fed into the combustion chamber. To reduce the pollutant emissions, fuel and air may be premixed to a uniform, lean mixture prior to combustion.

The fuel used is often natural gas, synthetic gas, oil or some combination of these. Where oil is used, an oil tip is inserted through a center body of a nozzle, such as a dry low NOx (DLN) style nozzle typically used to burn premixed natural gas. The disadvantage of such an arrangement is that the oil, burns as a diffusion flame with relatively high NOx emissions or a diluent such as steam has to be added to keep emissions low. Efforts to inject the oil through the same passages as the gas have therefore been attempted but found to be problematic due to the differing injector hole size requirements of oil versus gas. Also, injecting from the vane pack risks fouling of the oil along the vane.

BRIEF DESCRIPTION OF THE INVENTION

According to one aspect of the invention, a premixer is provided and includes a peripheral wall defining a mixing chamber therein through which a flow path for a fluid is defined, a nozzle including an annular splitter plate disposed in the flow path within the mixing chamber, the splitter plate including a trailing edge defined in relation to a predominant direction of fluid flow along the flow path and being formed to define a fuel line therein, which is receptive of oil fuel and an annular array of fuel injectors disposed at the trailing edge, which are each fluidly communicative with the fuel line and configured to inject at least the oil fuel into the flow path with the oil fuel being substantially atomized upon injection or substantially immediately after the injection by interaction with the fluid flowing along the flow path.

According to another aspect of the invention, a premixer is provided and includes a peripheral wall defining a mixing chamber therein through which a flow path for a fluid is defined, a nozzle including an annular splitter plate disposed within the mixing chamber to divide the flow path into inner and outer flow paths defined within the splitter plate and between the peripheral wall and the splitter plate, respectively, the splitter plate including a trailing edge defined in relation to a predominant direction of fluid flow along the flow paths and being formed to define a fuel line therein, which is receptive of oil fuel and an annular array of fuel injectors disposed at the trailing edge, which are each fluidly communicative with the fuel line and configured to inject at least the oil fuel into the inner and outer flow paths with the oil fuel being substantially atomized upon injection or substantially immediately after the injection by interaction with the fluid flowing along the flow path.

According to yet another aspect of the invention, a premixer is provided and includes a peripheral wall defining a mixing chamber therein through which a flow path for a fluid is defined, a center body disposed at least partially within the peripheral wall, first and second swirl vanes extending radially inwardly from the peripheral wall and radially outwardly from the center body, respectively, a nozzle including an annular splitter plate disposed radially between and extending downstream from the first and second swirl vanes, the splitter plate including a trailing edge defined in relation to a predominant direction of fluid flow along the flow path and being formed to define a fuel line therein, which is receptive of oil fuel, and an annular array of oil fuel injectors disposed at the trailing edge, which are each fluidly communicative with the fuel line and configured to inject at least the oil fuel into the flow path with the oil fuel being substantially atomized upon injection or substantially immediately after the injection by interaction with the fluid flowing along the flow path.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
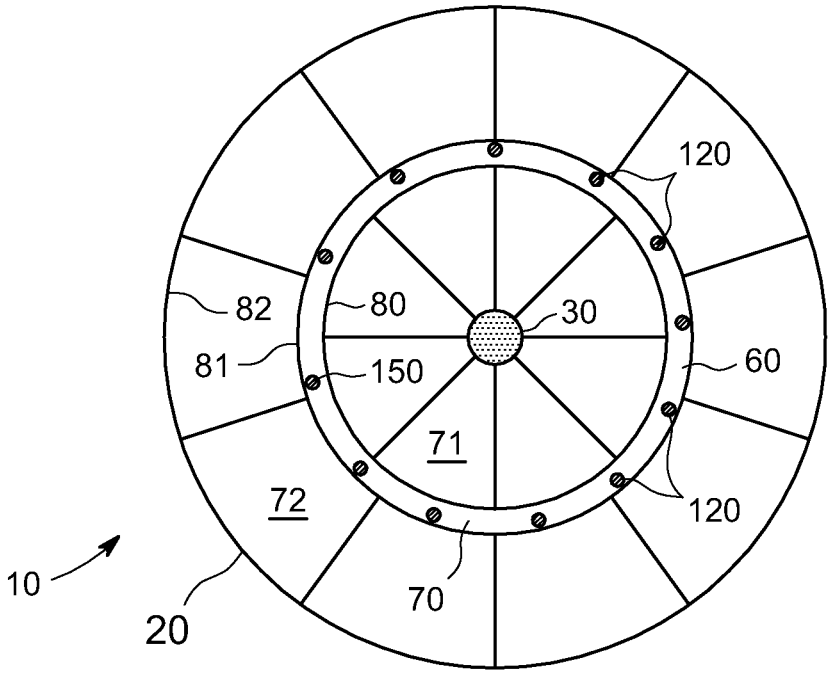
FIG. 1 is an axial schematic view of a premixer.
Figure 2:
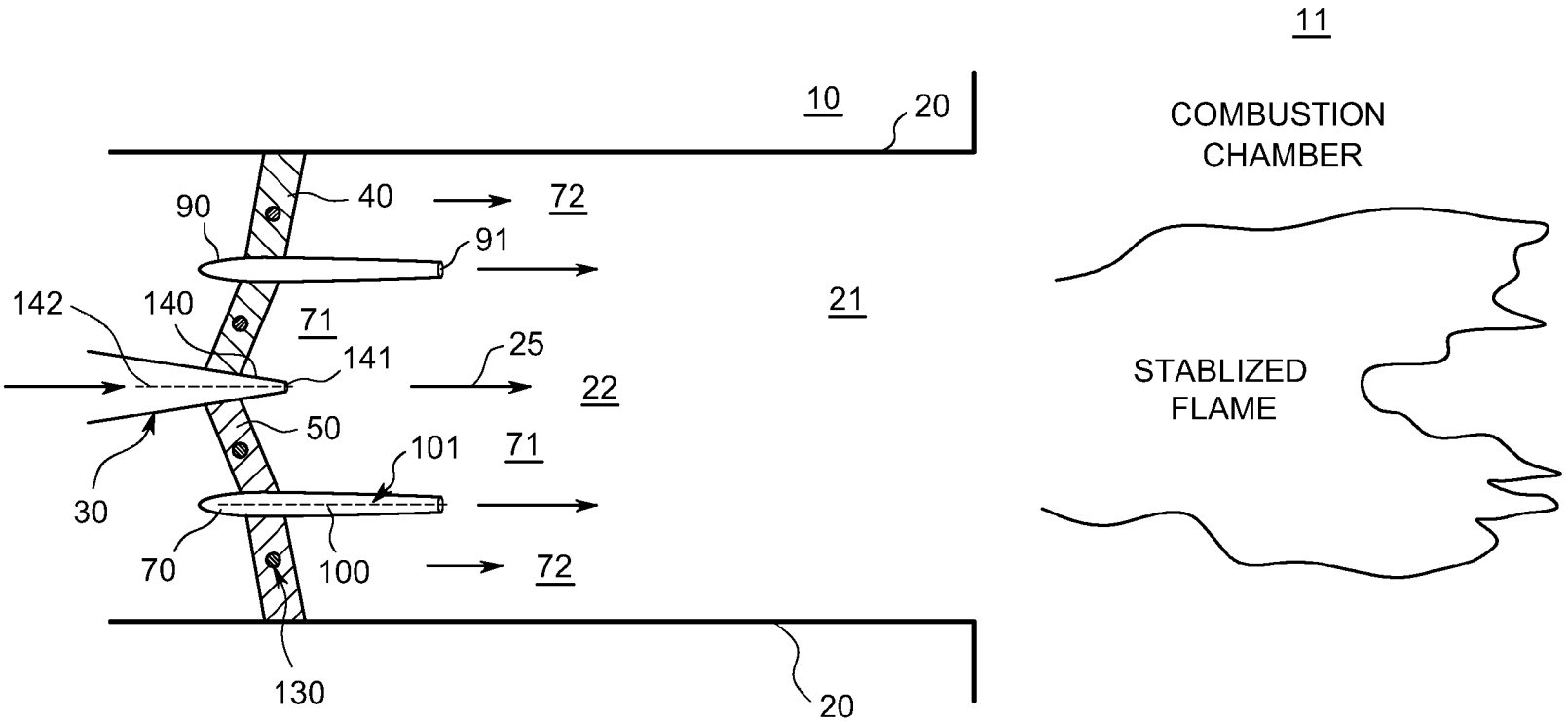
FIG. 2 is a side sectional view of the premixer of FIG. 1.
Figure 3:
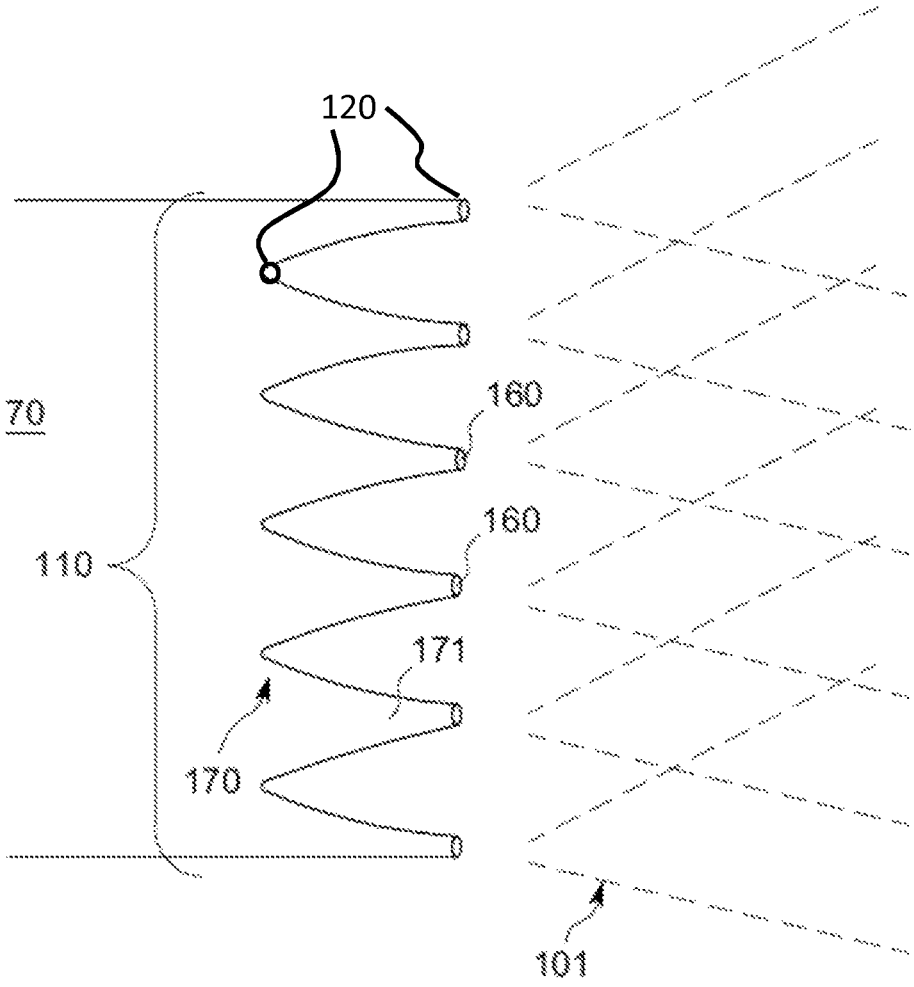
FIG. 3 is an enlarged view of an exemplary portion of the nozzle of the premixer of FIG. 1.

With reference to FIGS. 1-3, a premixer 10 of a combustor 11 is provided. The premixer 10 includes a peripheral wall 20, which defines a mixing chamber 21 therein and through which a flow path 22 for a fluid 25, such as compressed air or an air/fuel mixture, is defined. The premixer 10 further includes a center body 30 disposed at least partially within the peripheral wall 20, first and second swirl vanes 40 and 50 and a nozzle 60.

The first swirl vanes 40 may be plural in number and extend radially inwardly from the peripheral wall 20. The second swirl vanes 50 may also be plural in number and extend radially outwardly from the center body 30. The first and second swirl vanes 40 and 50 may be angled or curved to impart swirl in similar or opposite directions or may be relatively flat and aligned along an axial dimension relative to the flow path 22 to offer structural support without a swirling effect.

The nozzle 60 includes an annular splitter plate 70, which is formed as an annular ring-shaped plate. The splitter plate 70 is disposed within the mixing chamber 21 to thereby divide the flow path 22 into an inner flow path 71 and an outer flow path 72. The inner flow path 71 is thus defined within an annular region delimited by an interior facing surface 80 of the splitter plate 70. Similarly, the outer flow path 72 is thus defined within an annular region between the peripheral wall 20 and the splitter plate 70, which is delimited by an exterior facing surface 81 of the splitter plate 70 and an interior facing surface 82 of the peripheral wall 20. In alternate embodiments, the nozzle 60 may include multiple annular splitter plates 70 of different diameters. The shape of each splitter plate 70 could also vary from, e.g., ring-shaped to sinusoidal or other suitable shapes.

The splitter plate 70 includes a leading edge 90 and a trailing edge 91, which are aligned and defined in relation to a predominant direction of a flow of the fluid 25 along the inner and outer flow paths 71 and 72. The leading edge 90 and the trailing edge 91 are formed at opposing connections of the interior and exterior facing surfaces 80 and 81. The splitter plate 70 is formed to define a fuel line 100 therein, which is receptive of a supply of oil fuel 101, such as diesel fuel. The splitter plate 70 is further formed to define an annular array 110 of annularly discrete splitter plate fuel injectors 120 at the trailing edge 91.

The splitter plate fuel injectors 120 are each fluidly communicative with the fuel line 100 and configured to inject at least the oil fuel 101 and/or other desired fuels and/or diluents into at least a shear layer between the inner and outer flow paths 71 and 72 with the oil fuel 101 having been substantially atomized upon the injection or substantially immediately after the injection by the interaction of the oil fuel 101 with the fluid 25 flowing along the flow paths 71 and 72.

That is, upon injection or substantially immediately after the injection, at least the oil fuel 101 exits the splitter plate fuel injectors 120 in a spray or stream and immediately interacts with the fluid 25 moving along the flow paths 71 and 72. High liquid fuel atomization pressure causes the injected oil fuel 101 to form a spray of fine droplets, which interacts with the fluid 25 in at least the shear layer with high turbulent mixing. Because the liquid fuel atomization and oil fuel 101 spray/air interaction happen inside the free shear layers downstream of the splitter plate 70 and the first and second swirl vanes 40 and 50, it prevents the oil fuel 101 from fouling along the splitter plate 70 even where the fluid 25 has a high characteristic temperature that would otherwise cause the oil fuel 101 to foul. Other fluids could be injected with the oil fuel 101, such as steam, nitrogen and/or natural gas, to aid in atomization.

The first and second swirl vanes 40 and 50 may be formed to define additional fuel injectors 130 to inject fuel, such as natural gas or synthetic gas, into the flow path 22. These additional fuel injectors 130 may be operated along with or in sequence with the splitter plate fuel injectors 120. For example, where both the additional fuel injectors 130 and the splitter plate fuel injectors 120 inject synthetic gas into the flow path 22, they may be operative simultaneously. Conversely, the additional fuel injectors 130 are generally though not necessarily non-operative when the splitter plate fuel injectors 120 inject the oil fuel 101 into the flow path 22.

The center body 30 may include a diffusion tip 140 at a trailing end 141 thereof or may be shortened to prevent an occurrence of oil fuel 101 coking thereon. Where the center body 30 includes the diffusion tip 140, the splitter plate fuel injectors 120 may be disposed axially proximate to or downstream from the center body 30 trailing end 141. In accordance with embodiments, the diffusion tip 140 and the trailing end 141 may be formed to define a passage 142 or multiple passages 142 therein for additional injection of at least one of fuel, air and/or inert gases.

As shown in FIG. 1, the splitter plate fuel injectors 120 may be formed as orifices 150 defined at the splitter plate trailing edge 91. In other embodiments, as shown in FIG. 3, the splitter plate fuel injectors 120 may include fuel tips 160, which are configured to create a predefined spray pattern of the oil fuel 101. The injectors may be simple orifices of various shapes, or pressure-swirl injectors, such as "simplex" injectors which may promote a wider spray and smaller droplet size.

The trailing edge 91 of the splitter plate 70 may terminate at a substantially uniform axial location. In alternate embodiments, the trailing edge 91 may be scalloped 170 with the splitter plate fuel injectors 120 disposed at scallop tips 171. These scallop tips 171 may be in line with or obliquely angled relative to the flow path 22. In still further embodiments, the splitter plate fuel injectors 120 may be axially set back from a plane defined by the scallop tips 171 formed by the trailing edge 91.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A premixer, comprising:

a peripheral wall defining a mixing chamber therein through which a flow path for a fluid is defined;

a center body having a trailing end and being disposed at least partially within the peripheral wall;

a nozzle including an annular splitter plate disposed in the flow path within the mixing chamber, the splitter plate including a trailing edge defined in relation to a predominant direction of fluid flow along the flow path and being formed to define a fuel line therein, which is receptive of oil fuel, the trailing edge of the splitter plate being defined downstream from the trailing end of the center body; and an annular array of annularly discrete fuel injectors disposed at the trailing edge, which are each fluidly communicative with the fuel line and configured to inject at least the oil fuel into the flow path with the oil fuel being substantially atomized upon injection or substantially immediately after the injection by interaction with the fluid flowing along the flow path, wherein the trailing edge of the splitter plate is scalloped and the fuel injectors are disposed at scallop tips.

2. The premixer according to claim 1, wherein the fuel injectors inject additional fuel and/or diluents into the flow path.

3. The premixer according to claim 1, wherein the scallop tips are obliquely angled relative to the flow path.

4. The premixer according to claim 1, wherein the fuel injectors are axially set back from a plane defined by scallop tips formed by the trailing edge.

5. A premixer, comprising:

a peripheral wall defining a mixing chamber therein through which a flow path for a fluid is defined;

a center body having a trailing end and being disposed at least partially within the peripheral wall;

a nozzle including an annular splitter plate disposed within the mixing chamber to divide the flow path into inner and outer flow paths defined within the splitter plate and between the peripheral wall and the splitter plate, respectively, the splitter plate including a trailing edge defined in relation to a predominant direction of fluid flow along the flow paths and being formed to define a fuel line therein, which is receptive of oil fuel, the trailing edge of the splitter plate being defined downstream from the trailing end of the center body; and an annular array of annularly discrete fuel injectors disposed at the trailing edge, which are each fluidly communicative with the fuel line and configured to inject at least the oil fuel into the inner and outer flow paths with the oil fuel being substantially atomized upon injection or substantially immediately after the injection by interaction with the fluid flowing along the flow path, wherein the trailing edge of the splitter plate is scalloped and the fuel injectors are disposed at scallop tips.

6. The premixer according to claim 5, wherein the fuel injectors inject additional fuel and/or diluents into the flow paths.

7. The premixer according to claim 5, wherein the scallop tips are obliquely angled relative to the flow paths.

8. The premixer according to claim 5, wherein the fuel injectors are axially set back from a plane defined by scallop tips formed by the trailing edge.

9. The premixer according to claim 1, wherein the splitter plate includes interior and exterior facing surfaces, the trailing edge being defined at a connection of the interior and exterior facing surfaces.

* * * * *